US009976749B2

(12) United States Patent
Yang et al.

(10) Patent No.: US 9,976,749 B2
(45) Date of Patent: May 22, 2018

(54) COOKING APPLIANCE

(71) Applicant: SAMSUNG ELECTRONICS CO., LTD., Suwon-si, Gyeonggi-do (KR)

(72) Inventors: Sung Pyo Yang, Yongin-si (KR); Sung Kwang Kim, Hwaseong-si (KR); Yun Ic Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 265 days.

(21) Appl. No.: 14/706,035

(22) Filed: May 7, 2015

(65) Prior Publication Data

US 2015/0323191 A1 Nov. 12, 2015

(30) Foreign Application Priority Data

May 8, 2014 (KR) ..... 10-2014-0055099

(51) Int. Cl.
*F24C 3/12* (2006.01)
*H01H 13/14* (2006.01)

(52) U.S. Cl.
CPC ..... *F24C 3/12* (2013.01); *F24C 3/126* (2013.01); *H01H 13/14* (2013.01)

(58) Field of Classification Search
CPC ..... F24C 3/12
USPC ..... 126/42, 39 A, 39 E
See application file for complete search history.

(56) References Cited

U.S. PATENT DOCUMENTS 2,648,305 A * 8/1953 Appleman ..... H01H 9/182 116/310
3,186,398 A * 6/1965 Poracki ..... F24C 3/027 126/214 R
3,814,077 A * 6/1974 Riehl ..... F24C 3/10 126/39 A
4,417,483 A 11/1983 Howie, Jr.
5,406,932 A * 4/1995 Joseph ..... F24C 3/067 126/15 A
6,140,627 A 10/2000 Jeon
9,038,621 B2 * 5/2015 Cadima ..... F24C 3/126 126/39 E
2007/0017308 A1 1/2007 Baek
2007/0044786 A1 3/2007 Frost et al.
2009/0151505 A1 6/2009 Castillo
(Continued)

FOREIGN PATENT DOCUMENTS

KR 10-2007-00656 11 6/2007

OTHER PUBLICATIONS

Extended European Search Report dated Sep. 8, 2015 in related European Patent Application No. 15166603.9 (7 pages).
(Continued)

*Primary Examiner* — Avinash Savani
(74) *Attorney, Agent, or Firm* — Staas & Halsey LLP

(57) ABSTRACT

A cooking appliance having a coupling structure of components to a control panel. The cooking appliance includes a main body provided with a heating unit, a control panel on at least a portion of the main body, a coupled knob unit for controlling a condition of the heating unit, the knob unit coupled to the control panel, and a bracket coupled to the knob unit to fix a coupling position of the knob unit. Accordingly, during a manufacturing process or a use process, the knob unit can be prevented from being biased with respect to the control panel in an arbitrary one direction.

20 Claims, 9 Drawing Sheets

(56) References Cited

U.S. PATENT DOCUMENTS

| | | | | |
|---|---|---|---|---|
| 2010/0054717 | A1* | 3/2010 | Lee | F24C 15/327 392/401 |
| 2010/0216080 | A1* | 8/2010 | Home | F24C 3/126 431/13 |
| 2010/0264344 | A1 | 10/2010 | Shaffer et al. | |
| 2012/0125318 | A1 | 5/2012 | Cadima | |

OTHER PUBLICATIONS

Communication under Rule 71(3) dated Jul. 26, 2017 in corresponding European Patent Application No. 15 166 603.9, 32 pages.

* cited by examiner

COOKING APPLIANCE

CROSS-REFERENCE TO RELATED APPLICATION

This application claims the benefit of Korean Patent Application No. 10-2014-0055099, filed on May 8, 2014 in the Korean Intellectual Property Office, the disclosure of which is incorporated herein by reference.

BACKGROUND

1. Field

Embodiments of the present invention relate to a cooking appliance, and more particularly, to a cooking appliance having an improved coupling structure of a component and a control panel of the cooking appliance.

2. Description of the Related Art

There are various kinds of cooking appliances. While an oven range in which an oven and a cooktop are coupled is exemplarily described, the present invention is not limited thereto but may be applied to a range including only a cooktop.

The oven range includes a main body having a cabinet shape. An oven is provided in the main body, and a cooktop including at least one heating unit is provided on the main body. Electricity or a gas is used as an energy source for heating a cooking material.

In the case of the oven range, a control panel is provided at any one of a front surface and an upper surface of the main body.

The control panel may be provided with a plurality of buttons, a keypad, a knob unit, and so on, configured to allow a user to set a cooking mode or various conditions needed for cooking. The control panel may include a display unit configured to allow a user to check a cooking mode, a cooking condition, a cooking progress state, and so on, which are currently set.

In particular, when the knob unit is disposed at the control panel, a user can rotate the knob unit to adjust an operation of the main body. In a use process in which a user rotates the knob unit or a processing process in which the knob unit is coupled to the control panel, the knob unit may be disposed to be biased with respect to the control panel in an arbitrary one direction. This is because a tolerance between parts occurs during a coupling process of the knob unit to cause an assembly error. In this case, appearance quality is decreased, and the main body may not be normally operated even when the user rotates the knob unit.

SUMMARY

Therefore, it is an aspect of the present invention to provide a cooking appliance having an improved structure configured to prevent a knob unit from being biased in an arbitrary one direction and coupled with respect to a control panel.

Additional aspects of the invention will be set forth in part in the description which follows and, in part, will be obvious from the description, or may be learned by practice of the invention.

A cooking appliance having a coupling structure of components to a control panel. The cooking appliance includes a main body provided with a heating unit, a control panel on at least a portion of the main body, a coupled knob unit for controlling a condition of the heating unit, the knob unit coupled to the control panel, and a bracket coupled to the knob unit to fix a coupling position of the knob unit. Accordingly, during a manufacturing process or a use process, the knob unit can be prevented from being biased with respect to the control panel in an arbitrary one direction. In accordance with one aspect of the present invention, there is provided a cooking appliance including: a main body provided with a heating unit; a control panel disposed on at least a portion of the main body; a valve, at least a portion of which is disposed inside the main body to adjust at least one of opening/closing of a gas and an amount of the gas supplied into the heating unit; a knob unit coupled to the control panel to adjust the opening/closing level of the valve; and a bracket disposed between the valve and the knob unit and coupled to fix the valve to the control panel.

The valve may be inserted into one bracket, and the valve may be inserted into one knob unit.

The bracket may include a knob coupling section coupled to the knob unit, and a valve coupling section coupled to the valve.

The knob coupling section may be configured to support a rear surface of the knob unit, and the valve coupling section may be configured such that at least the portion of the valve is inserted thereinto.

At least a portion of the knob unit may be coupled to a front surface of the control panel, and the bracket may be coupled to a rear surface of the control panel.

The cooking appliance may further include a burner coupled to the heating unit and configured to heat the heating unit using the supplied gas, wherein the burner may receive a gas through a main pipe.

The cooking appliance may further include at least one sub pipe having one side connected to the main pipe and the other side connected to the valve to connect the valve and the main pipe.

The sub pipe may be coupled to the valve to connect the valve to the main pipe.

The main pipe may be divided into a plurality of branch pipes to be connected to the valve.

The knob unit may include a manipulation unit disposed at a front surface of the control panel to be manipulated, and a holder unit configured to fix the manipulation unit to the control panel.

The cooking appliance may further include a fixing member fixed between the manipulation unit and the holder unit to prevent the manipulation unit from being separated from the holder unit.

In accordance with another aspect of the present invention, there is provided a cooking appliance including: a main body provided with a heating unit; a control panel disposed on at least a portion of the main body; a valve configured to adjust at least one of opening/closing of a gas and an amount of the gas supplied into the heating unit, and coupled to the control panel; a knob unit including a manipulation unit coupled to the control panel to adjust the opening/closing level of the valve and disposed at a front surface thereof, and a holder unit configured to fix the manipulation unit; and a fixing member disposed between the knob unit and the valve and configured to prevent the knob unit from being biased in an arbitrary one direction.

The fixing member may be coupled to the holder unit of the knob unit and formed of a flexible material to attenuate an impact generated due to a contact of the knob unit with the control panel.

The cooking appliance may further include at least one main pipe configured to supply a gas into the heating unit, and a plurality of branch pipes branched off from the main pipe to be coupled to at least one of the valves.

The one branch pipe may be connected to a plurality of valves, and the branch pipe may be directly coupled to the valve.

The one branch pipe may be connected to one valve.

The cooking appliance may further include a sub pipe configured to connect each of the branch pipes and each of the valves.

Each of the branch pipes may be connected to one sub pipe, and each of the sub pipes may be connected to one valve.

In accordance with still another aspect of the present invention, there is provided a cooking appliance including: a main body; a control panel coupled to the main body; a knob unit coupled to the control panel to adjust an operation of the main body; and a bracket configured to support the knob unit to prevent the knob unit from being spaced apart from a determined position.

The one bracket may be coupled to the one knob unit.

The cooking appliance may further include a valve coupled to the knob unit to be opened/closed according to an operation of the knob unit, wherein the bracket may include a knob coupling section coupled to the knob unit, and a valve coupling section coupled to the valve.

The knob coupling section may be configured to support a rear surface of the knob unit at both sides thereof, and the valve coupling section may be coupled to support at least a portion of a surface of the valve.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
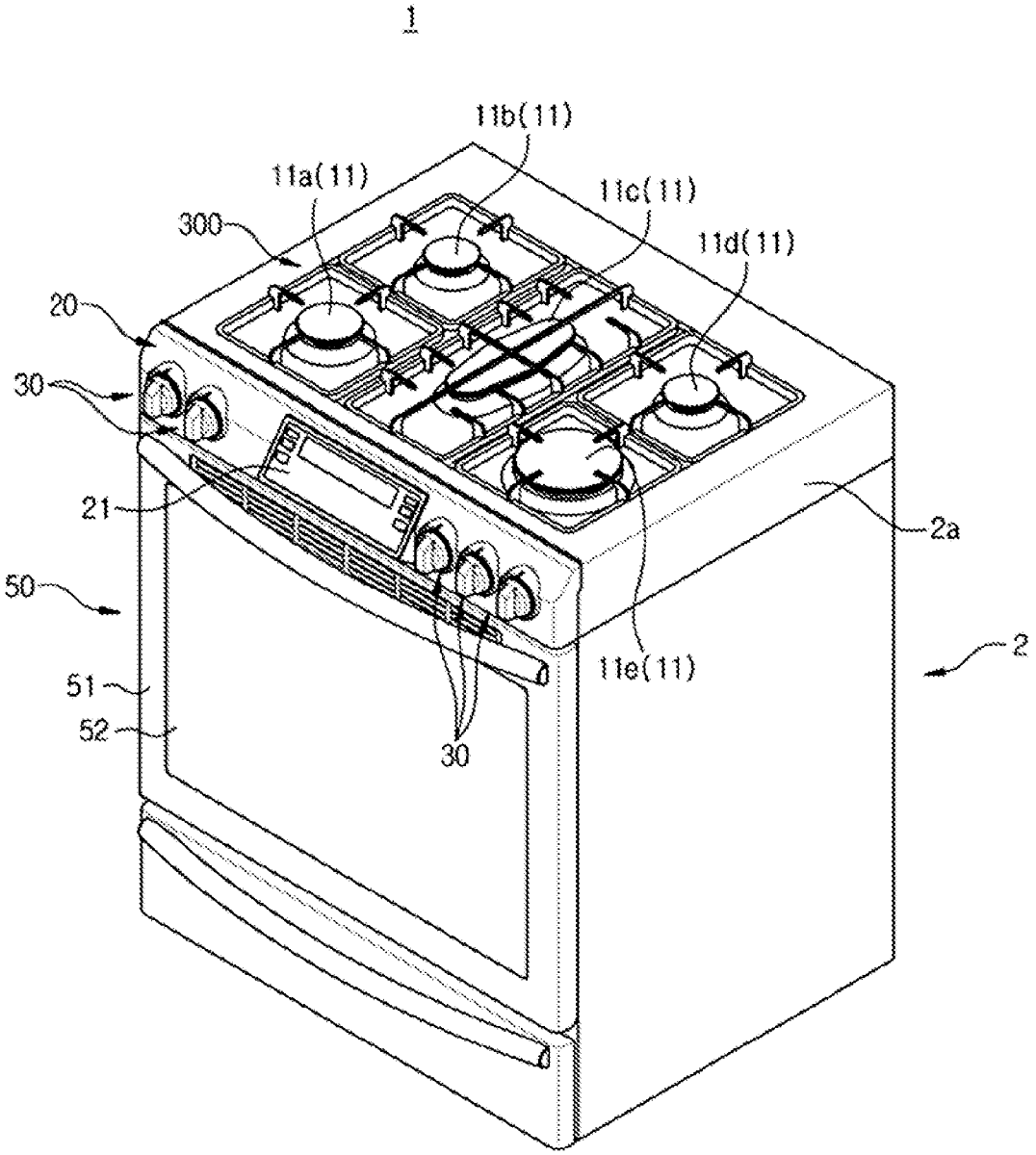
FIG. 1 is a view showing a cooking appliance according to an embodiment of the present invention.

Reference will now be made in detail to the embodiments of the present invention, examples of which are illustrated in the accompanying drawings, wherein like reference numerals refer to like elements throughout. Hereinafter, while an oven range including an oven will be exemplarily described, the embodiments of the present invention may also be applied to the case in which a control panel is applied even when a cooking appliance does not include an oven.

FIG. 1 is a view showing a cooking appliance according to an embodiment of the present invention.

As shown in FIG. 1, a cooking appliance 1 according to the embodiment of the present invention may include an oven 50 and a cooktop 300. The cooktop 300 is disposed at an upper surface of a main body 2, and the oven 50 is disposed at a front surface. A cavity (not shown) is formed in the oven 50, and a cooking material is received in the cavity to be cooked.

In addition, a control panel 20 configured to manipulate operations of the oven 50 and the cooktop 300 may be coupled to at least a portion of the main body 2. According to the embodiment of the present invention, the control panel 20 may be formed on a front surface of the main body 2. A knob unit 30 configured to manipulate the cooktop 300 and the oven 50 may be coupled to the control panel 20. According to the embodiment of the present invention, five knob units 30 may be provided. A knob unit (not shown) configured to manipulate the oven 50 may be additionally provided. In addition, a display unit 21 configured to display an operation state of the cooking appliance 1, including the main body 2, may be provided at the control panel 20.

The cooktop 300 may be provided at an upper surface 2*a* of the main body 2. The cooktop 300 includes a heating unit 11 configured to heat a cooking material. According to the embodiment of the present invention, while the heating unit 11 is operated by receiving a gas, the present invention is not limited thereto but the heating unit may be operated by receiving electricity. According to the drawings, five heating units 11*a*, 11*b*, 11*c*, 11*d*, and 11*e* may be provided, and thus, five knob units 30 of the control panel 20 may also be provided.

The oven 50 is provided under the control panel 20. The oven 50 may include a door 51 configured to selectively open or close a front surface of the cavity (not shown). The door 51 may be provided with a window 52 configured to allow a cooking state of foods accommodated in the cavity (not shown) to be seen with the naked eye.

Figure 2:
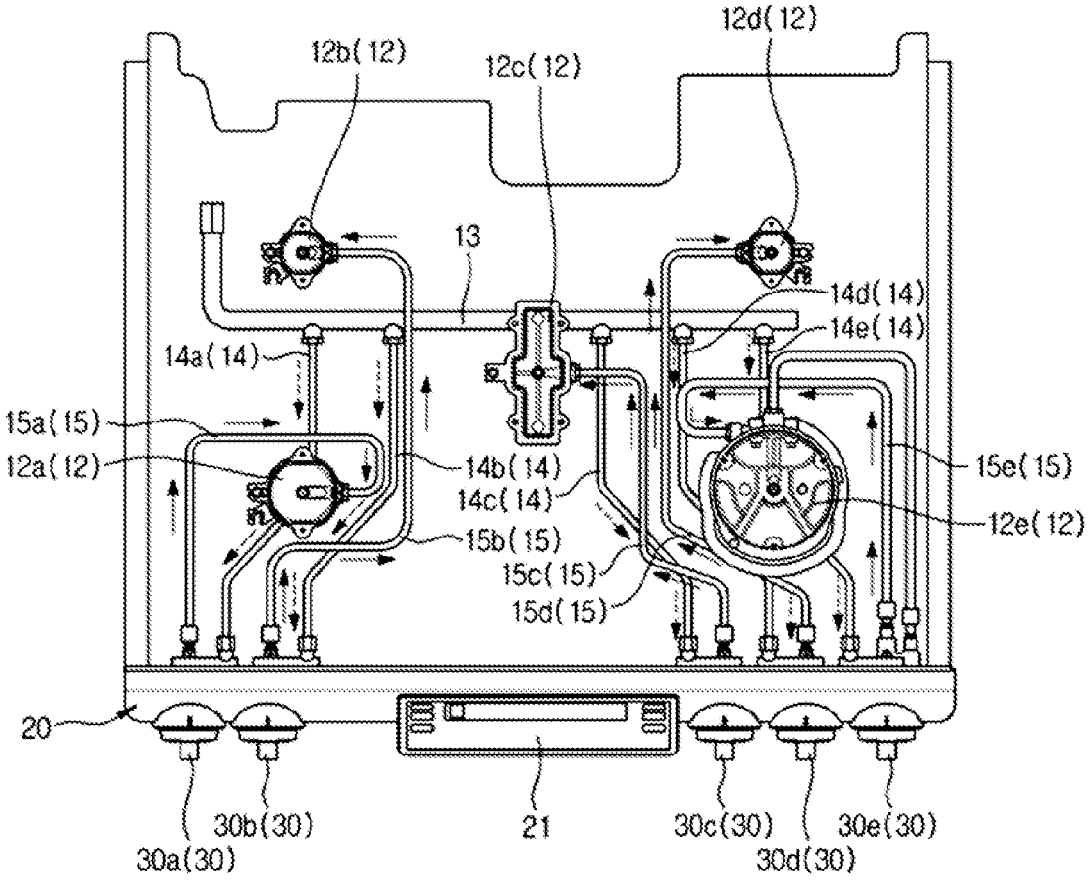
FIG. 2 is a plan view showing a state in which an upper cover is removed from the cooking appliance according to the embodiment of the present invention.
Figure 3:
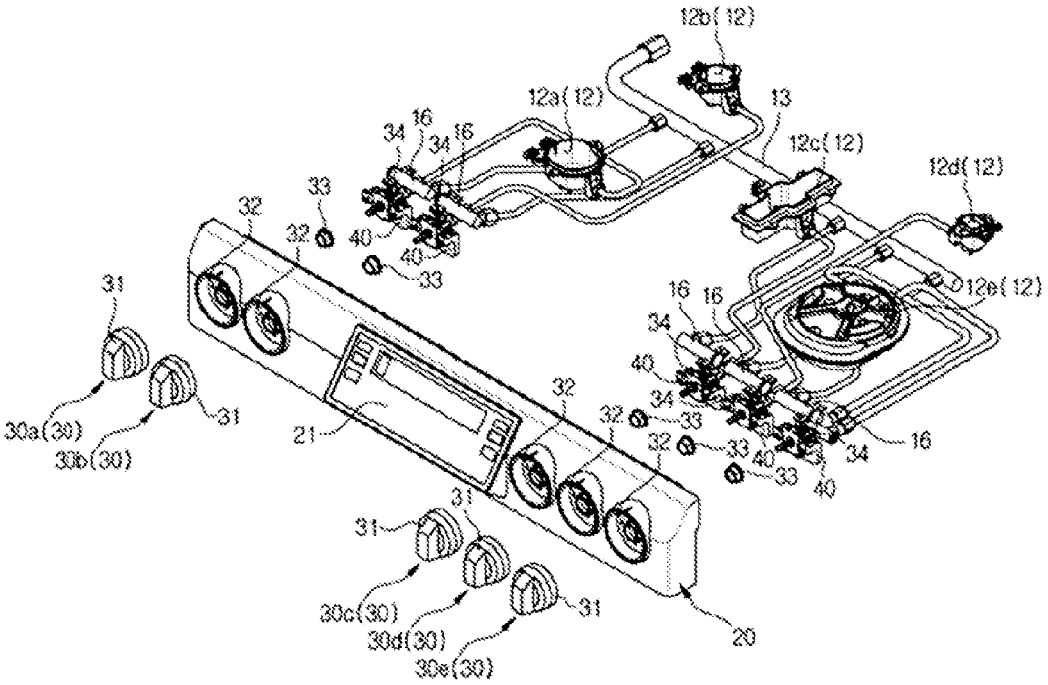
FIG. 3 is an exploded perspective view showing some of components of the cooking appliance according to the embodiment of the present invention.

FIG. 2 is a plan view showing a state in which an upper cover is removed from the cooking appliance according to the embodiment of the present invention, and FIG. 3 is an exploded perspective view showing some of the components of the cooking appliance according to the embodiment of the present invention. Dotted lines represent a flow of a gas supplied from a main pipe to valves, and solid lines represent a flow of a gas supplied from the valves to burners.

As shown in FIGS. 2 and 3, a burner 12 configured to heat the heating unit 11 may be disposed under the heating unit 11. The burner 12 receives a gas and heats the heating unit 11. According to the embodiment of the present invention, the five heating units 11*a*, 11*b*, 11*c*, 11*d*, and 11*e* are provided, and five burners 12*a*, 12*b*, 12*c*, 12*d*, and 12*e* are also provided.

The burners 12*a*, 12*b*, 12*c*, 12*d*, and 12*e* may be connected to the knob units 30*a*, 30*b*, 30*c*, 30*d*, and 30*e* coupled to the control panel 20. The knob unit 30 may be connected to a valve 34 configured to adjust at least one of opening/closing of the gas or an amount of the gas. Accordingly, the knob unit 30 can be adjusted to determine the amount of the gas supplied into the burner 12 and opening/closing of the gas. According to the embodiment of the present invention, the five knob units 30 can also be provided to adjust the knob units 30*a*, 30*b*, 30*c*, 30*d*, and 30*e* to thereby adjust operations of the heating units 11*a*, 11*b*, 11*c*, 11*d*, and 11*e*.

The burners 12*a*, 12*b*, 12*c*, 12*d*, and 12*e* receive a gas through a main pipe 13. According to the embodiment of the present invention, a plurality of branch pipes 14 branched off from the main pipe 13 may be provided. According to the drawings, the five branch pipes 14*a*, 14*b*, 14*c*, 14*d*, and 14*e* are branched off from the main pipe 13 to connect a valve 34 and the main pipe 13. The gas moving from the main pipe 13 to the valve 34 through the branch pipe 14 passes through the valve 34 to be supplied into the burner 12. A connecting pipe 15 is disposed between the valve 34 and the burner 12 to supply the gas into the burner 12. Since the gas is supplied through the valve 34, a user can manipulate the knob unit 30 to open/close the valve 34 to enable supply of the gas into the burner 12 and adjustment of the amount of the gas. The branch pipe 14 branched off from the main pipe 13 and the connecting pipe 15 are coupled to each of the valves 34. In addition, one of the branch pipes 14 may be connected to one of the valves 34. One of the connecting pipes 15 may also be connected to one of the valves 34. According to the embodiment of the present invention, since the five valves 34 are provided as the five burners 12*a*, 12*b*, 12*c*, 12*d*, and 12*e* are provided, the five branch pipes 14*a*, 14*b*, 14*c*, 14*d*, and 14*e* and the five connecting pipes 15*a*, 15*b*, 15*c*, 15*d*, and 15*e* are provided.

The knob unit 30 may include a manipulation unit 31 disposed at a front surface of the control panel 20 and a holder unit 32 configured to fix the manipulation unit 31 to the control panel 20. The user can rotate the manipulation unit 31 to adjust an opening/closing level of the valve 34. The holder unit 32 is coupled to the control panel 20, and the manipulation unit 31 is inserted into the holder unit 32. Then, the holder unit 32 is fixed such that the manipulation unit 31 is inserted into the control panel 20.

A fixing member 33 configured to prevent the knob unit 30 from being biased in an arbitrary one direction may be coupled between the valve 34 and the knob unit 30. The fixing member 33 is coupled to the holder unit 32 to prevent the manipulation unit 31 from being biased in the arbitrary one direction such that the knob unit 30 is not deviated from (or retained in, maintained in, retract to) a determined position, for example, with respect to a desired or specified appearance quality, assembly position, or operation position. That is, the fixing member 33 may be disposed between the manipulation unit 31 and the holder unit 32 to prevent the manipulation unit 31 from being separated from the holder unit 32 due to an impact. In addition, even when a coupling shaft 34*a* (see FIG. 5) of the valve 34 is curved, the fixing member 33 may be disposed between the valve 34 and the knob unit 30 to prevent the knob unit 30 from being biased in an arbitrary one direction.

The fixing member 33 may be formed of a flexible material to attenuate an impact generated due to a contact between the knob unit 30 and the control panel 20. More specifically, when the knob unit 30 is biased in an arbitrary one direction, a noise may be generated due to a contact with the control panel 20. The fixing member 33 can prevent the knob unit 30 from being biased in the arbitrary one direction, and can be formed of a flexible material to prevent generation of the noise due to the contact between the knob unit 30 and the control panel 20.

A bracket 40 may be coupled to each of the valves 34. The bracket 40 is configured to prevent the valve 34 from being separated from a coupling position with respect to the control panel 20. Since the bracket 40 according to the embodiment of the present invention fixes a position of the valve 34, the knob unit 30 coupled to the valve 34 can be prevented from being biased in an arbitrary one direction. The bracket 40 is coupled to each of the valves 34. That is, the brackets 40 one-to-one correspond to the valves 34. Each of the valves 34 is inserted into one bracket 40, the bracket 40 is connected to one knob unit 30, and thus, each of the valves 34 may be connected to one knob unit 30. Since each of the brackets 40 is coupled to the control panel 20 with the knob unit 30 interposed therebetween, in a use process or a manufacturing process, the bracket 40 is fixed even when the control panel 20 is shaken or the knob unit 30 shaken, and thus, the valve 34 can be prevented from being separated from a certain position with respect to the control panel 20. The bracket 40 will be described below.

The cooking appliance 1 according to the embodiment of the present invention may further include at least one sub pipe 16 configured to connect the valve 34 and the main pipe 13. One side of the sub pipe 16 may be coupled to the valve 34, and the other side may be coupled to the main pipe 13. According to the embodiment of the present invention, the branch pipe 14 is disposed between the sub pipe 16 and the main pipe 13 to couple them. The sub pipe 16 is coupled to each of the valves 34, and according to the embodiment of the present invention, the five sub pipes 16 may be provided. In the related art, the main pipe 13 is not branched off, and there is no separate sub pipe 16. Accordingly, in the related art, as a tolerance is generated between parts in an assembly process of the valve 34 or an assembly process of the knob unit 30 to cause an assembly error, and the knob unit 30 is biased in a certain direction as a whole to decrease appearance quality. That is, in the related art, since the valve is directly coupled to the main pipe, when a tolerance is generated between the main pipe and the valve, the knob unit coupled to the valve may be biased and coupled. In addition, even when the assembly tolerance is generated between the valve and the control panel, the knob unit coupled to the valve may be biased and coupled to decrease appearance quality. In addition, in the related art, even when the assembly tolerance is generated between the knob unit and only one valve, the appearance quality can be decreased as a whole. However, according to the embodiment of the present invention, since the sub pipes are branched off from the one main pipe 13 to be coupled to the valves 34, generation of an error during the assembly process can be prevented, and the error can be removed by correcting only one position even though the error occurs.

Figure 4:
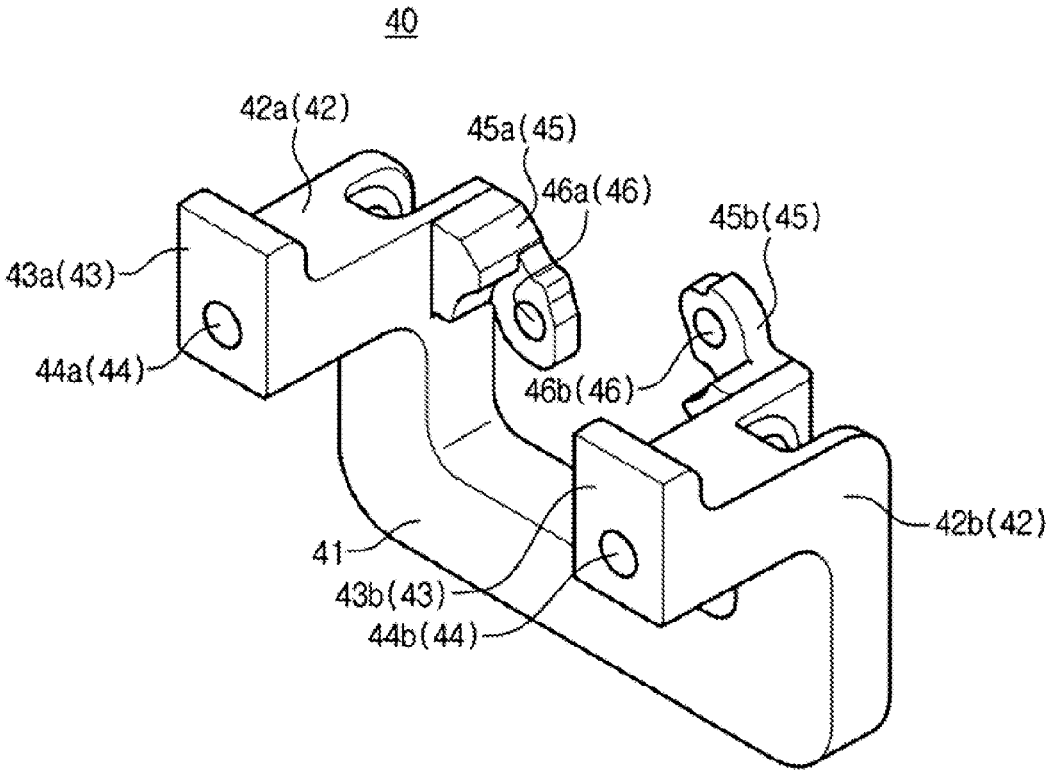
FIG. 4 is a view showing a bracket of the cooking appliance according to the embodiment of the present invention.

FIG. 4 is a view showing a bracket of the cooking appliance according to the embodiment of the present invention.

As shown in FIG. 4, the bracket 40 includes a knob coupling section 42 coupled to the knob unit 30 and a valve coupling section 46 coupled to the valve 34.

The knob coupling section 42 may protrude upward with respect to a body section 41 of the bracket 40. According to the embodiment of the present invention, the knob coupling section 42 is provided to support the knob unit 30 at a rear surface thereof. According to the embodiment of the present invention, the knob coupling section 42 may include a first knob coupling section 42*a* and a second knob coupling section 42*b* configured to support the knob unit 30 at both sides thereof. A distal end of the knob coupling section 42 may include a curved section 43 provided to be bent. As the knob coupling section 42 includes the first knob coupling section 42*a* and the second knob coupling section 42*b*, the curved section 43 may also include a first curved section 43*a* and a second curved section 43*b*. A separate fastening member (not shown) may be coupled to the curved section 43, and a coupling hole 44 configured to couple the bracket 40 to the control panel 20 may be provided.

According to the embodiment of the present invention, a valve coupling section 45 may extend from one side of the knob coupling section 42. The valve coupling section 45 may be configured such that at least a portion of the valve 34 is inserted thereinto. According to the embodiment of the present invention, the valve coupling section 45 may include a first valve coupling section 45*a* extending from one side of the first knob coupling section 42*a*, and a second valve coupling section 45*b* extending from one side of the second knob coupling section 42*b*. The first valve coupling section 45*a* and the second valve coupling section 45*b* may extend from the first knob coupling section 42*a* and the second knob coupling section 42*b* to have different directionalities. According to the embodiment of the present invention, the first valve coupling section 45*a* may extend downward, and the second valve coupling section 45*b* may extend upward. Since the valve 34 is rotated according to rotation of the knob unit 30, a space for rotation of the valve 34 should be provided.

Figure 5:
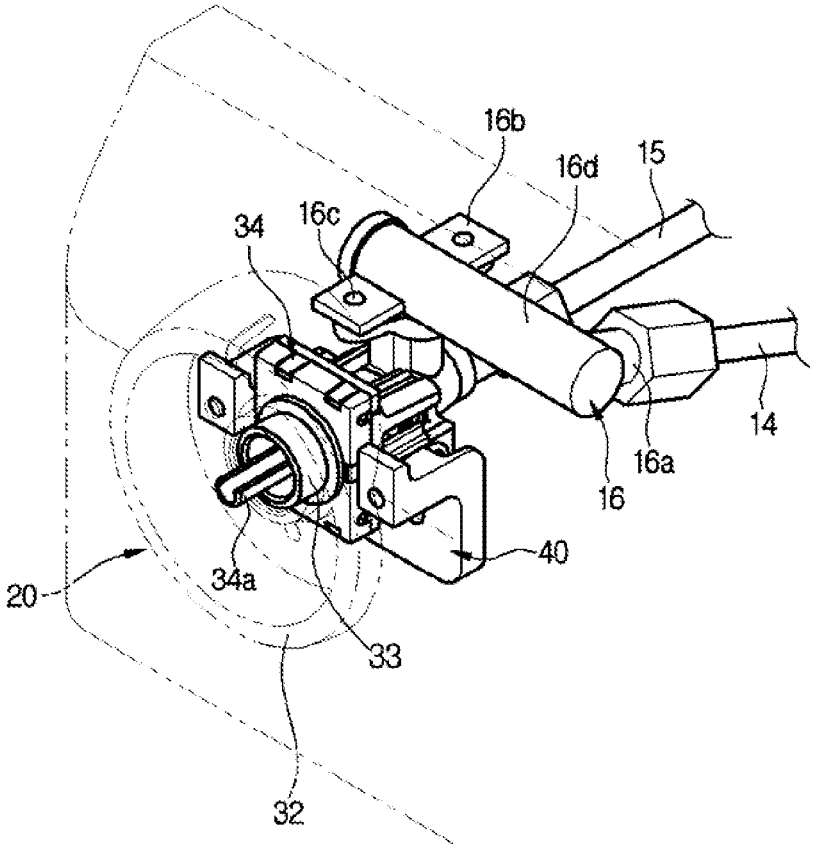
FIG. 5 is a view showing a state in which a knob unit of a control panel of the cooking appliance according to the embodiment of the present invention is removed.
Figure 6:
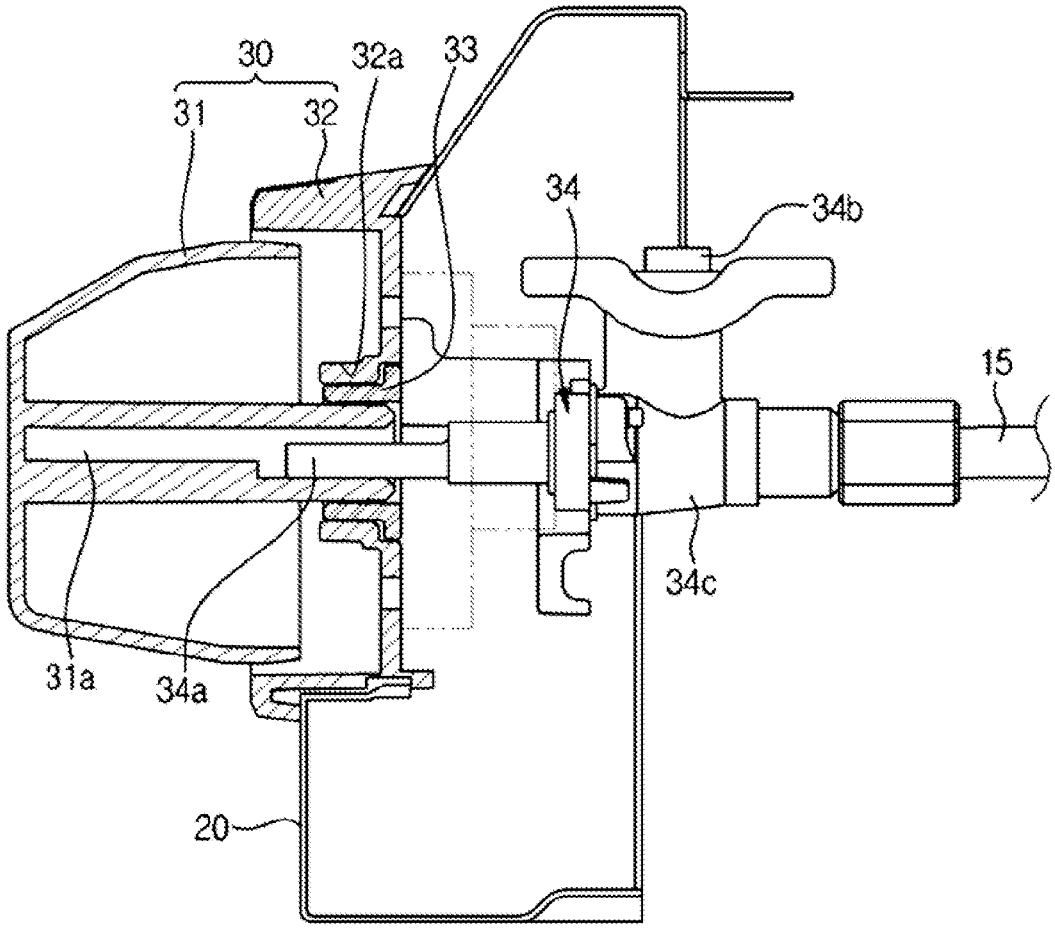
FIG. 6 is a cross-sectional view showing a cross-section of the control panel of the cooking appliance according to the embodiment of the present invention.

FIG. 5 is a view showing a state in which the knob unit of the control panel of the cooking appliance according to the embodiment of the present invention is removed. FIG. 6 is a cross-sectional view showing a cross-section of the control panel of the cooking appliance according to the embodiment of the present invention, and FIG. 7 is an exploded perspective view showing components coupled to the control panel of the cooking appliance according to the embodiment of the present invention.

Figure 7:
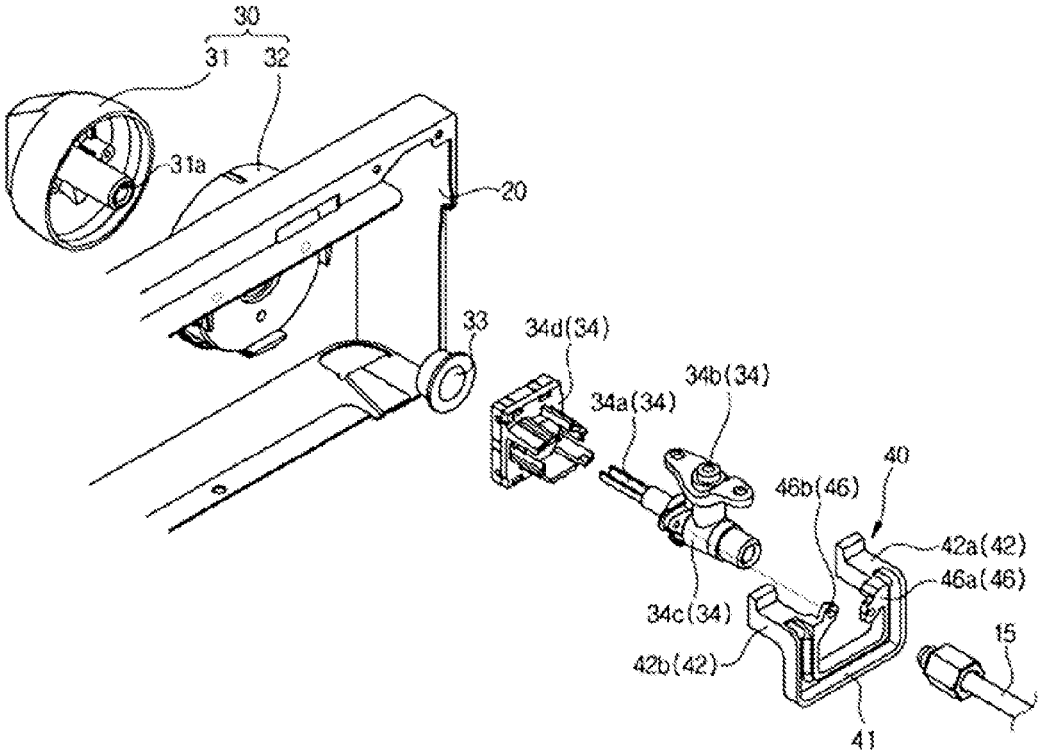
FIG. 7 is an exploded perspective view of components coupled to the control panel of the cooking appliance according to the embodiment of the present invention.

As shown in FIGS. 5 to 7, at least a portion of the knob unit 30 is coupled to the front surface of the control panel 20, and the bracket 40 is coupled to a rear surface of the control panel 20. More specifically, the manipulation unit 31 of the knob unit 30 may be coupled to the front surface of the control panel 20 to enable the user's manipulation. The holder unit 32 may be coupled to the front surface of the control panel 20. The bracket 40 to which the valve 34 is fastened may support a rear surface 32*a* of the holder unit 32, and may be coupled to the control panel 20 and the holder unit 32 through a fastening member (not shown) from the outside of the control panel 20.

The valve 34 may include a body section 34*c* and the coupling shaft 34*a* extending from the body section 34*c*. The coupling shaft 34*a* may pass through the control panel 20 to be coupled to the manipulation unit 31 of the knob unit 30. More specifically, the coupling shaft 34*a* of the valve 34 may be coupled to a coupling section 31*a* of the manipulation unit 31, and thus, the user can manipulate the valve 34 by manipulating the manipulation unit 31.

The valve 34 may include a bracket coupling section 34*d* coupled to the bracket 40. The bracket coupling section 34*d* may have a shape corresponding to the body section 41 of the bracket 40. The coupling shaft 34*a* of the valve 34 passes through the bracket coupling section 34*d* to form the valve 34, and the valve 34 is fastened to the bracket 40. The valve coupling section 46 of the bracket 40 may be coupled to come in contact with at least a portion of the body section 34*c* of the valve 34.

The connecting pipe 15 may be coupled to one side of the body section 34*c* of the valve 34. In addition, the main pipe 13 may be connected to the other side of the valve 34. According to the embodiment of the present invention, the sub pipe 16 may be coupled to the valve 34 and the gas supplied from the main pipe 13 may be transmitted to the valve 34. A sub pipe coupling section 34*b* is provided at the body section 34*c* of the valve 34 and the sub pipe coupling section 34*b* is coupled to the sub pipe 16. The sub pipe 16 may be coupled to the branch pipe 14 branched off from the main pipe 13 to supply the gas into the valve 34. Fastening holes 16*b* and 16*c* configured to fasten fastening members (not shown) may be formed in the sub pipe 16, and the valve 34 and the sub pipe 16 may be coupled by fastening the fastening members (not shown) using the fastening holes 16*b* and 16*c*. In addition, the sub pipe 16 may include a branch pipe coupling section 16*a*, to which the branch pipe 14 is coupled, such that the branch pipe 14 can be coupled thereto.

The fixing member 33 may be inserted between the manipulation unit 31 and the holder unit 32. The fixing member 33 may be inserted to surround at least a portion of the coupling section 31*a* of the manipulation unit 31. The manipulation unit 31 is rotated in a state in which the user presses the manipulation unit 31 to be pushed toward the inside of the control panel 20, and at this time, the valve 34 is manipulated therewith. However, when the valve 34 is bent or the knob unit 30 is biased in a certain direction, the manipulation unit 31 may not return to its original position. However, in the case of the embodiment of the present invention, since the fixing member 33 is disposed between the manipulation unit 31 and the holder unit 32, the manipulation unit 31 can be prevented from not being returned to the original position from the pushed state.

Figure 8:
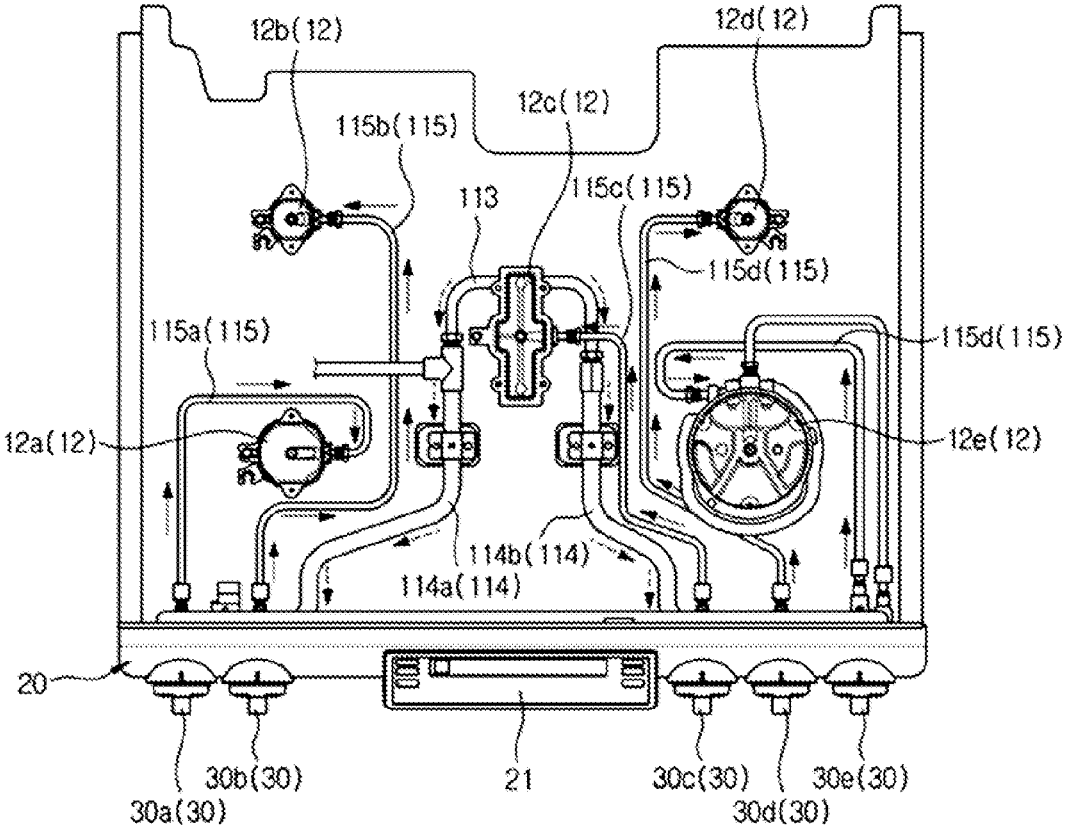
FIG. 8 is a plan view showing a state in which an upper cover is removed from a cooking appliance according to another embodiment of the present invention.
Figure 9:
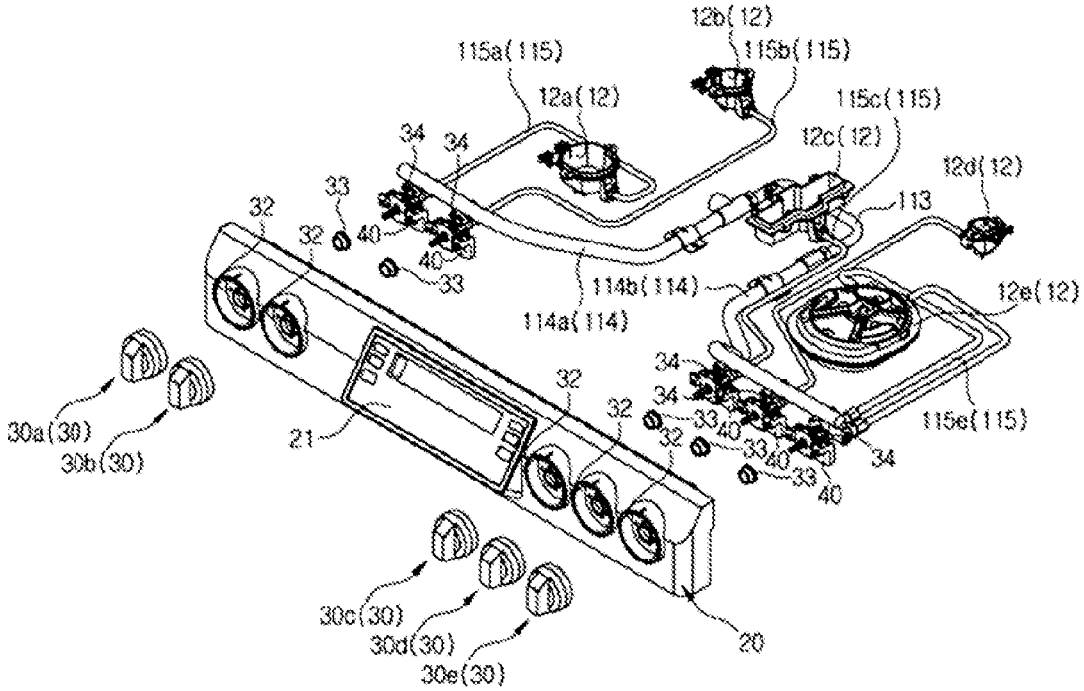
FIG. 9 is an exploded perspective view showing some of components of the cooking appliance according to the other embodiment of the present invention.

FIG. 8 is a plan view showing a state in which an upper cover is removed from a cooking appliance according to another embodiment of the present invention, and FIG. 9 is an exploded perspective view showing some of the components of the cooking appliance according to the other embodiment of the present invention. Dotted lines represent a flow of the gas supplied from a main pipe 113 into the valve 34, and solid lines represent a flow of the gas supplied from the valve 34 into the burner 12.

As shown in FIGS. 8 and 9, the burner 12 is provided under the heating unit 11, and the burner 12 is provided to be connected to the valve 34.

The gas is supplied from the main pipe 113 into the valve 34, and the gas is supplied from the valve 34 into the burner 12 to heat the cooking material. According to the embodiment of the present invention, the main pipe 113 may be divided into a plurality of branch pipes 114. According to the embodiment of the present invention, the main pipe 113 may be divided into two branch pipes 114*a* and 114*b*. In the case of the embodiment of the present invention shown in FIGS. 8 and 9, the branch pipes 114 may be coupled to both sides of the main pipe 113 to divide the main pipe 113 into two parts.

In addition, according to the embodiment of the present invention, the branch pipe 114 may be directly coupled to the valve 34. Accordingly, unlike the embodiment of the present invention shown in FIGS. 1 to 7, the sub pipe is not needed.

According to the embodiment of the present invention, the two valves 34 are coupled to the first branch pipe 114*a*, and the three valves 34 are coupled to the second branch pipe 114*b*. In this case, the sub pipe coupling section 34*b* of the valve 34 may be coupled to the branch pipe 114. In addition, in this case, unlike the embodiment of the present invention shown in FIGS. 1 to 7, the plurality of valves 34 may be coupled to the one branch pipe 114.

In addition, even in the case of the embodiment of the present invention shown in FIGS. 8 and 9, the bracket 40 is coupled to the valve 34. A fixing member 33 may be coupled to the knob unit 30 to prevent the manipulation unit 31 from being separated from the holder unit 32.

As is apparent from the above description, according to the embodiment of the present invention, during the manufacturing process or the use process, the knob unit can be prevented from being biased in an arbitrary one direction with respect to the control panel and coupled thereto.

Accordingly, a decrease in appearance quality of the cooking appliance can be prevented, and inconvenience that may occur during using of the cooking appliance may be solved.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cooking appliance, comprising:

a main body provided with a heating unit;

a control panel on at least a portion of the main body;

a valve, at least a portion of which is disposed inside the main body to adjust an amount of gas supplied into the heating unit, the valve comprising a body section, and a coupling shaft which passes through the control panel;

a knob unit coupled to the control panel outside of the main body and couple-able to the valve to adjust opening/closing level of the valve to control the amount of the gas supplied into the heating unit, the coupling shaft of the valve being coupled to the knob unit; and a bracket coupled to the knob unit and the control panel inside the main body and to the valve disposed inside the main body, to be disposed between the valve and the knob unit, to thereby fix a coupling position of the knob unit to the control panel and fix a position of the valve with respect to the control panel through the bracket coupled to the knob unit, the control panel and the valve, the bracket including a valve coupling section coupled to a part of the body section and a knob coupling section projecting in the body section.

2. The cooking appliance according to claim 1, wherein the valve is inserted into the bracket, and the valve is inserted into the knob unit.

3. The cooking appliance according to claim 1, wherein the knob coupling section is configured to support a rear surface of the knob unit toward the inside of the main body, and the valve coupling section is configured such that at least a portion of the valve is inserted thereinto.

4. The cooking appliance according to claim 1, wherein at least a portion of the knob unit is coupled to a front surface of the control panel, and the bracket is coupled to a rear surface of the control panel toward the inside of the main body.

5. The cooking appliance according to claim 1, further comprising a burner coupled to the heating unit and configured to heat the heating unit using the supplied gas, wherein the burner receives a gas through a main pipe.

6. The cooking appliance according to claim 5, further comprising at least one sub pipe having one side of the sub pipe connected to the main pipe and another other side of the sub pipe connected to the valve, thereby the sub pipe connecting the valve and the main pipe.

7. The cooking appliance according to claim 6, wherein the sub pipe is coupled to the valve to connect the valve to the main pipe.

8. The cooking appliance according to claim 5, wherein the main pipe is divided into a plurality of branch pipes to be connected to the valve.

9. The cooking appliance according to claim 1, wherein the knob unit comprises a manipulation unit and a holder unit, the manipulation unit disposed to couple to the holder unit at a front surface of the control panel to be manipulated, and the holder unit configured to fix the manipulation unit to the front surface of the control panel.

10. The cooking appliance according to claim 9, further comprising a fixing member coupled between the manipulation unit and the holder unit to prevent the manipulation unit from being separated from the holder unit.

11. A cooking appliance, comprising:

a main body provided with a heating unit;

a control panel on at least a portion of the main body;

a valve configured to adjust an amount of gas supplied into the heating unit, and coupled to the control panel, the valve comprising a body section, and a coupling shaft which passes through the control panel;

a knob unit including a manipulation unit and a holder unit, the manipulation unit coupled at a front surface of the control panel to the valve to adjust opening/closing level of the valve to control the amount of the gas supplied into the heating unit, and a holder unit configured to fix the manipulation unit, the coupling shaft of the valve being coupled to the knob unit;

a bracket inside the main body and coupled to the knob unit and the control panel, the bracket being configured to maintain the knob unit in a position with respect to the control panel and to maintain a position of the valve with respect to the control panel through coupling with the knob unit; and a fixing member disposed inside the main body and coupled to the holder unit of the knob unit interposed between the knob unit and the valve and configured to prevent the knob unit from being biased in an arbitrary one direction, the bracket including a valve coupling section coupled to a part of the body section and a knob coupling section projecting in the body section.

12. The cooking appliance according to claim 11, wherein the fixing member is formed of a flexible material to attenuate an impact generated due to a contact of the knob unit with the control panel.

13. The cooking appliance according to claim 11, wherein the valve is among a plurality of valves, and the cooking appliance further comprises at least one main pipe configured to supply the gas into the heating unit, and a plurality of branch pipes branched off from the main pipe to be coupled to at least one of the valves.

14. The cooking appliance according to claim 13, wherein one branch pipe is connected to the plurality of valves, and the one branch pipe is directly coupled to the plurality of valves.

15. The cooking appliance according to claim 13, wherein one branch pipe is connected to one valve.

16. The cooking appliance according to claim 14, further comprising sub pipes configured to connect respectively the plurality of branch pipes and the plurality of valves.

17. The cooking appliance according to claim 16, wherein the one branch pipe is connected to one sub pipe, and the one sub pipe is connected to the one valve.

18. A cooking appliance, comprising:

a main body including a control panel surface;

a valve, at least a portion of which is disposed inside the main body to adjust an amount of gas supplied into the heating unit, the valve comprising a body section, and a coupling shaft which passes through the control panel;

a knob unit including a manipulation unit, the knob unit coupled to the control panel outside surface to adjust an operation, the coupling shaft of the valve being coupled to the knob unit; and a bracket inside the main body and coupled to the knob unit and the control panel, the bracket configured to maintain the knob unit in a first position with respect to the control panel surface and to not deviate to a second position with respect to the control panel surface, the bracket including a valve coupling section coupled to a part of the body section and a knob coupling section projecting in the body section.

19. The cooking appliance according to claim 18, wherein the coupling shaft of the valve is coupled to the knob unit to enable the valve to be opened/closed according to an operation of the knob unit.

20. The cooking appliance according to claim 19, wherein the knob coupling section of the bracket is configured to support a rear surface of the knob unit inside the main body, and the valve coupling section of the knob unit is coupled to support at least a portion of a surface of the valve.

* * * * *